US006650852B2

(12) United States Patent
Makino

(10) Patent No.: US 6,650,852 B2
(45) Date of Patent: Nov. 18, 2003

(54) IMAGE FORMING APPARATUS HAVING A FIXING DEVICE

(75) Inventor: Kazumasa Makino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/987,120

(22) Filed: Nov. 13, 2001

(65) Prior Publication Data

US 2002/0057935 A1 May 16, 2002

(30) Foreign Application Priority Data

Nov. 13, 2000 (JP) ..... 2000-345509

(51) Int. Cl.[7] ..... G03G 15/20

(52) U.S. Cl. ..... 399/122; 399/328; 399/330; 219/216

(58) Field of Search ..... 399/122, 320, 399/328, 330; 219/216

(56) References Cited

U.S. PATENT DOCUMENTS 4,147,501 A * 4/1979 Goshima et al. ..... 219/216
4,154,575 A * 5/1979 Edwards et al. ..... 399/330
5,708,927 A * 1/1998 Etoh ..... 399/122
6,330,419 B1 * 12/2001 Sano et al. ..... 219/216

FOREIGN PATENT DOCUMENTS

| | | |
|---|---|---|
| JP | 53-135643 | 11/1978 |
| JP | A 4-131885 | 5/1992 |
| JP | A 7-49626 | 2/1995 |

* cited by examiner

*Primary Examiner*—Sandra Brase
(74) *Attorney, Agent, or Firm*—Oliff & Berridge, PLC

(57) ABSTRACT

An image forming apparatus includes a main body, a heat roller that heats toner of a toner image formed on a printing medium to fix the toner image, a heat roller gear that transmits a rotational driving force to the heat roller, a fixing device frame that supports the heat roller and the heat roller gear and is attached to the main body so as to rotate on a fixing point, a gear supporting member that supports a drive gear that transmits the driving force in engagement with the heat roller gear and is attached to the main body, a frame contact part that is provided in the fixing device frame, and a gear contact part that makes contact with the frame contact part. The fixing device frame is rotated on the fixing point by the rotational driving force the drive gear applies to the heat roller and the frame contact part makes contact with the gear contact part.

7 Claims, 9 Drawing Sheets

IMAGE FORMING APPARATUS HAVING A FIXING DEVICE

BACKGROUND OF THE INVENTION

1. Field of Invention

The invention relates to an image forming apparatus, and more specifically, to an arrangement of a fixing device for an image forming apparatus, such as an electrophotographic copier, an electrophotographic printer (i.e., a laser printer, an LED printer), a facsimile machine, and a word processor.

2. Description of Related Art

Conventionally, an image forming apparatus includes a fixing device to fix a toner image transferred onto a printing medium. The fixing device includes a heat roller and a pressure roller, which are disposed adjacent each other at respective roller surfaces. The printing medium fed into the fixing device is sandwiched between the heat roller and the pressure roller and fed by rotation of the heat roller. At this time, the toner is fixed onto the printing medium by the application of pressures of the heat roller and the pressure roller and the application of heat of the heat roller.

A drive gear supported to the main unit of the image forming apparatus drives a heat roller gear attached coaxially with the heat roller, which rotates the heat roller. If a pitch being a distance between a center of rotation of the drive gear and a center of rotation of the heat roller gear is not fixed, the rotation of the heat roller becomes unstable, thereby deteriorating image quality.

A known method for maintaining the pitch between the drive gear and the heat roller gear at a specific value is disclosed in Japanese Laid-Open Patent Publication No. 53-135643. In this method, the drive gear is attached to a main body frame to which the fixing device is mounted. A mating part is provided in the main body frame to make contact with a mating part in the fixing device. The fixing device is screwed to the main body frame via an elongated hole with the mating parts in contact with each other, thereby securing the fixing device at a determined position with respect to the main body frame. Therefore, the distance (pitch) between the center of rotation of the heat roller gear in the fixing device and the center of rotation of the drive gear in the main body frame is maintained at the specified value.

However, in this method, the screw to tighten the fixing device to the main body frame comes loose due to use over an extended period of time and vibrations, and the fixing device is shifted from the determined position with respect to the main body frame.

As a torque is transmitted from the drive gear to the heat roller gear, the torque acts on the entire fixing device. In particular, when the torque from the drive gear is great, the torque that acts on the entire fixing device is also great. As a result, if the fixing device is not firmly secured to the main body frame, the fixing device becomes misaligned. When the fixing device is shifted from the proper installation position in the main body frame, the rotation of the heat roller becomes unstable, and the image becomes distorted during fixing, thereby deteriorating the fixed image quality.

SUMMARY OF THE INVENTION

The invention provides an improved image forming apparatus that addresses the foregoing drawbacks associated with image forming apparatus.

According to an aspect of the invention, an image forming apparatus includes a main body; a heat roller that heats toner of a toner image formed on a printing medium to fix the toner image; a heat roller gear that transmits a rotational driving force to the heat roller; a fixing device frame that supports the heat roller and the heat roller gear and is attached to the main body; and a gear supporting member that supports a drive gear that transmits the driving force in engagement with the heat roller gear and is attached to the main body. At least one of the fixing device frame and the gear supporting member is relatively moved in a direction to approach the other by the driving force the drive gear transmits, while a distance between a rotation center of the heat roller gear and a rotation center of the drive gear is maintained to a specified value.

According to another aspect of the invention, an image forming apparatus includes a main body, a heat roller that heats toner of a toner image formed on a printing medium to fix the toner image, a heat roller gear that transmits a rotational driving force to the heat roller, a fixing device frame that supports the heat roller and the heat roller gear and is attached to the main body so as to rotate on a fixing point, a gear supporting member that supports a drive gear that transmits the driving force in engagement with the heat roller gear and is attached to the main body, a frame contact part that is provided in the fixing device frame, and a gear contact part that makes contact with the frame contact part. The fixing device frame is rotated on the fixing point by the rotational driving force the drive gear applies to the heat roller and the frame contact part makes contact with the gear contact part.

BRIEF DESCRIPTION OF THE DRAWINGS

The invention will be described in greater detail with reference to preferred embodiments thereof and the accompanying drawings wherein.

DETAILED DESCRIPTION OF PREFERRED EMBODIMENTS

A preferred embodiment of the invention will be described in detail with reference to the accompanying drawings.

Figure 1:
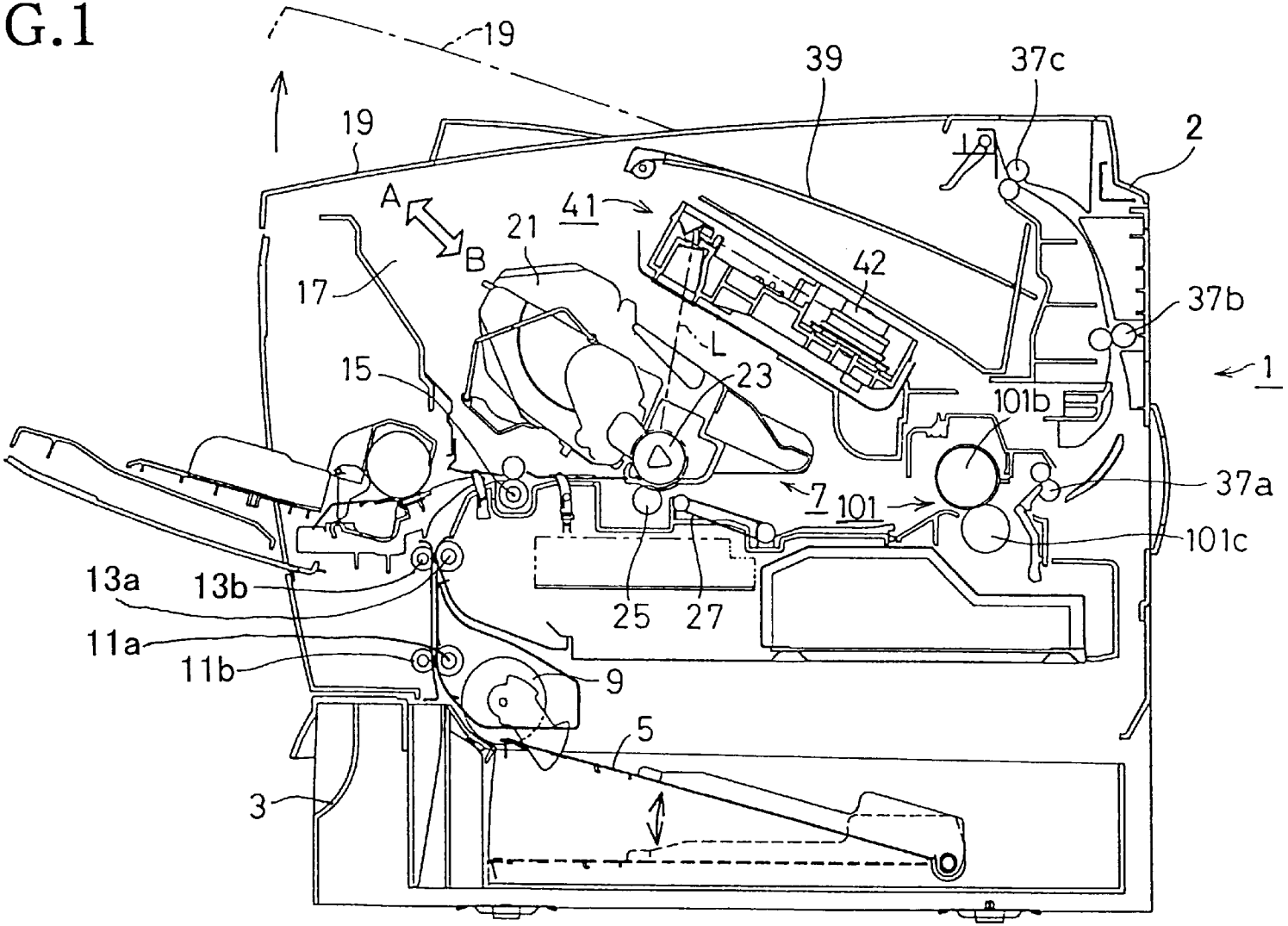
FIG. 1 is a cross sectional view of a laser printer of the invention.

As shown in FIG. 1, a laser printer 1 includes a main unit 2 and a paper tray 3, which is disposed in a lower part of the main unit 2 and detachably inserted therein. The paper tray 3 is provided with a supporting plate 5, which is upwardly urged by a spring (not shown). A supply roller 9 is disposed above the supporting plate 5 to supply a recording sheet to an image forming part 7 by separating it from a stack of sheets held on the supporting plate 5.

Two pair of conveying rollers 11, 13 and a resist roller 15 that stops as appropriate to engage with a leading edge of a sheet and correct skewing of the sheet are disposed on a paper conveying path where the sheet is conveyed from the supply roller 9 to the image forming part 7. Of each pair of conveying rollers 11, 13, one is a driving roller 11*a*, 13*a* which is rotated upon the drive from a motor (not shown), and the other is a driven roller 11*b*, 13*b* which is rotated as the sheet is transferred.

The image forming part 7 includes a photosensitive drum 23 as a photo conductor and a transfer roller 25 disposed facing the photosensitive drum 23. The photosensitive drum 23 is disposed in a process cartridge 21, and the transfer roller 25 is disposed in the main unit 2. At a position downstream of the image forming part 7 (in the right part of FIG. 1), a conveying belt 27 and a fixing device 101 including a heat roller 101*b* and a pressure roller 101*c* are disposed. Further, three pair of paper discharge rollers 37*a*, 37*b*, 37*c* are disposed downstream from the fixing device 101 along the paper conveying path. A paper discharge tray 39 which receives a sheet to be discharged from the last paper discharge roller 37*c* is provided on the upper surface of the main unit 2.

A scanner unit 41 that scans a laser beam L over the photosensitive drum 23 and exposes the photosensitive drum 23 to the laser beam L is disposed between the paper discharge tray 39 and the process cartridge 21. The scanner unit 41 is provided with various optical elements, such as a polygon mirror 42 rotated by a motor (not shown), for the purpose of scanning the laser beam L radiated from a laser diode (not shown) for image formation.

As shown in FIG. 1, the process cartridge 21 is detachably attached to a mounting part 17, which is an opening toward an upper part of the main unit 2 in directions indicated by A and B. The opening at the upper part of the main unit 2 is normally covered by a cover 19 pivotally mounted to the main unit 2. The process cartridge 21 can be detached by opening the cover 19.

Figure 2:
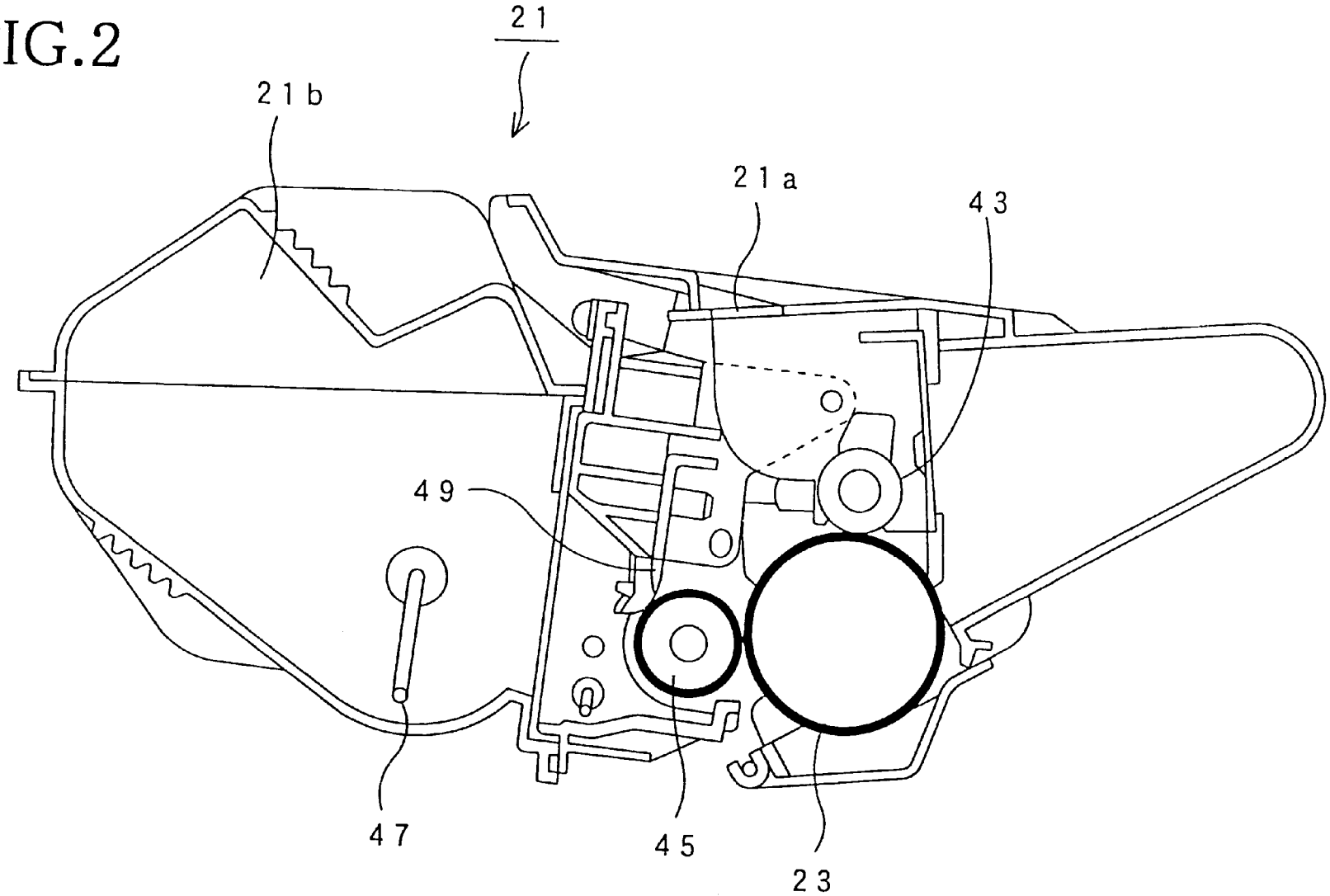
FIG. 2 is a cross sectional view of a process cartridge of the invention.

As shown in FIG. 2, the process cartridge 21 is provided with the photosensitive drum 23 having a photosensitive layer on the surface, which is rotatably mounted, a charging roller 43 that uniformly charges the surface of the photosensitive drum 23, and a developing roller 45 that supplies toner onto the surface of the charged photosensitive drum 23. The charging roller 43 and the developing roller 45 are driven by the photosensitive drum 23.

On the surface of the photosensitive drum 23 charged by the charging roller 43, an electrostatic latent image is formed by the laser beam L incident from the scanner unit 41 via an exposure opening 21*a*. When the developing roller 45 supplies the toner as a developing agent to the surface of the photosensitive drum 23, the electrostatic latent image on the photosensitive drum 23 is developed as a toner image or a visible image. At this time, the toner is adhered on a charged part of the photosensitive drum 23 where the latent image is formed. The toner is not adhered on a part that does not become charged.

The transfer roller 25 presses a recording sheet against the photosensitive drum 23. A voltage is applied to the transfer roller 25 to attract the toner toward the recording sheet, and the toner image on the photosensitive drum 23 is transferred onto the recording sheet. The toner image transferred onto the recording sheet is fixed by the fixing device 101.

The photosensitive drum 23 is, for example, a member where an induction photoelectric layer is applied to the surface and which can form the latent images by selective light exposure. As the developing agent, the toner is, for example, of organic macromolecular fine powder elements including a dye and a charge control agent. The printing medium is, for example, a sheet of paper and/or an overhead transparency film.

The process cartridge 21 is further provided with a toner feeding member 47 that agitates and sends the toner in a toner container 21*b* to the developing roller 45, a layer thickness-regulating blade 49 that causes the toner adhered on the surface of the developing roller 45 to frictionally become charged and regulates the toner to a predetermined thickness, and other known parts.

During the process of printing in a laser printer 1 one of the recording sheets on the paper tray 3 is taken by the supply roller 9 and fed to the resist roller 15 via the conveying rollers 11, 13, and corrected as to skewing at the resist roller 15. Then, the recording sheet is fed to the image forming part 7. When the recording sheet passes between the photosensitive drum 23 and the transfer roller 25, the toner adhered on the photosensitive drum 23 is transferred onto the recording sheet to form the image (the toner image) on the recording sheet.

The recording sheet on which the toner image is formed is conveyed to the fixing device 101 by the conveying belt 27. In the fixing device 101, the recording sheet is sandwiched between the heat roller 101*b* and the pressure roller 101*c*. The toner on the recording sheet is heated by the heat roller 101*b* to fix the toner image onto the recording sheet and image formation is completed. The recording sheet on which the toner image is fixed through the fixing device 101 is fed by three pair of discharge paper rollers 37*a*, 37*b*, 37*c*, and finally ejected to the paper discharge tray 39 provided at the top of the main unit 2.

Figure 3:
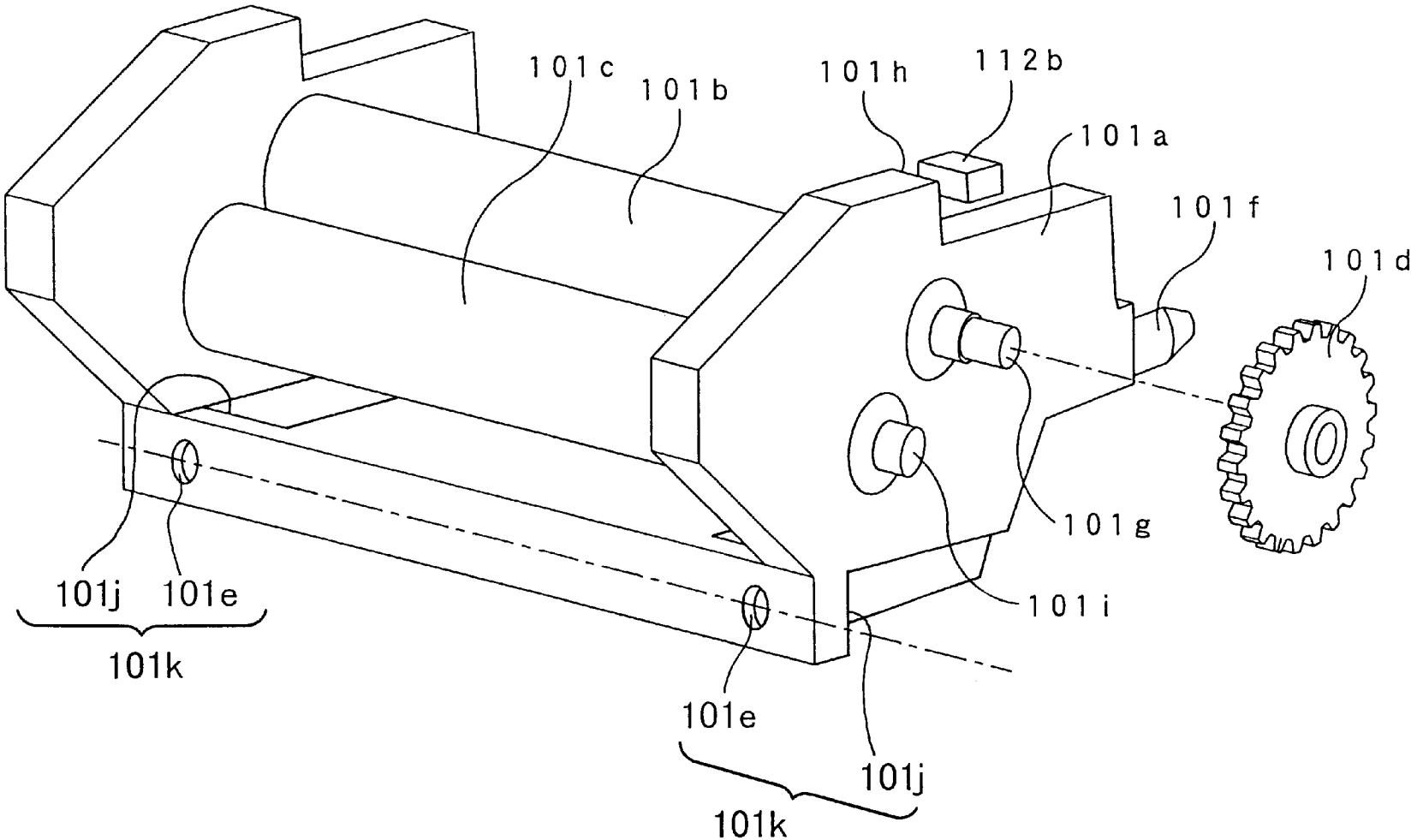
FIG. 3 is a perspective view of a fixing device of the invention.

As shown in FIG. 3, the fixing device 101 is made up of the heat roller 101*b*, the pressure roller 101*c*, a heat roller gear 101*d*, a heat roller shaft 101*g*, a pressure roller shaft 101*i*, and a fixing device frame 101*a*, which holds the constituent parts therein.

The heat roller 101*b* is heated by a halogen heater (not shown) disposed inside when toner fixing is performed. The heat roller gear 101*d* has a toothed wheel with a pressure angle $\alpha$ of 20°. The heat roller 101*b* and the heat roller gear 101*d* are fixed on the heat roller shaft 101*g*, which is rotatably supported to the fixing device frame 101*a*.

Figure 5:
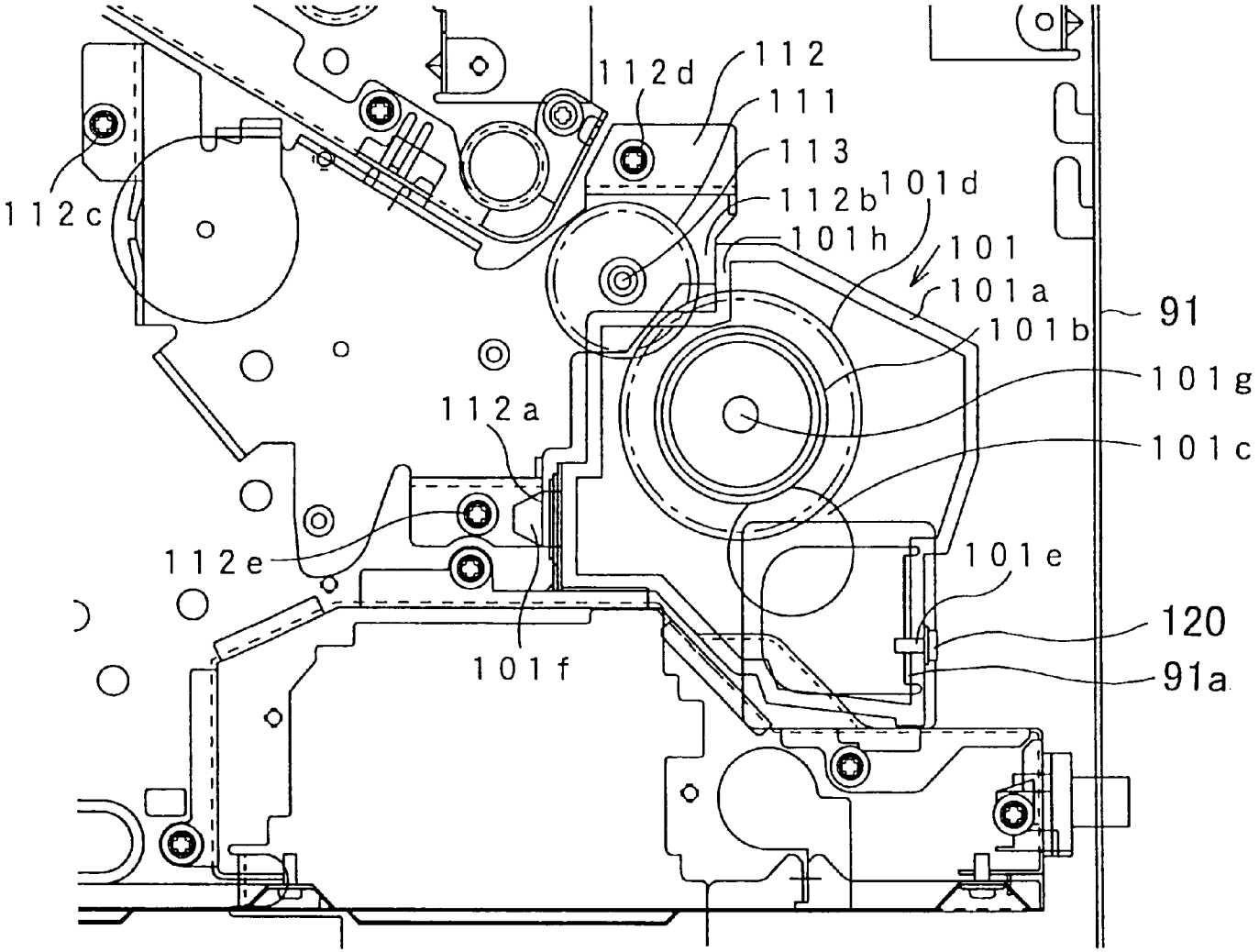
FIG. 5 is a side view showing the fixing device and its peripheral parts of the invention when a drive gear is stopped.

As shown in FIG. 5, the heat roller gear 101*d* is engaged with a drive gear 111 driven by a motor (not shown). A gear plate 112 is integrally fixed to a supporting frame 91 of the main unit 2 using screws 112*c*, 112*d*, 112*e*. The drive gear 111 is rotatably supported to the gear plate 112. A supporting shaft 113 is held upright on the gear plate 112, and the drive gear 111 is supported on the supporting shaft 113. The drive gear 111 is connected to a motor (not shown) via a line of gears.

The pressure roller 101*c* is placed on the pressure roller shaft 101*i*, which is rotatably supported to the fixing device frame 101*a* and urged to the heat roller 101*b*. Thus, a roller surface of the pressure roller 101*c* makes contact with a roller surface of the heat roller 101*b*.

Figure 4:
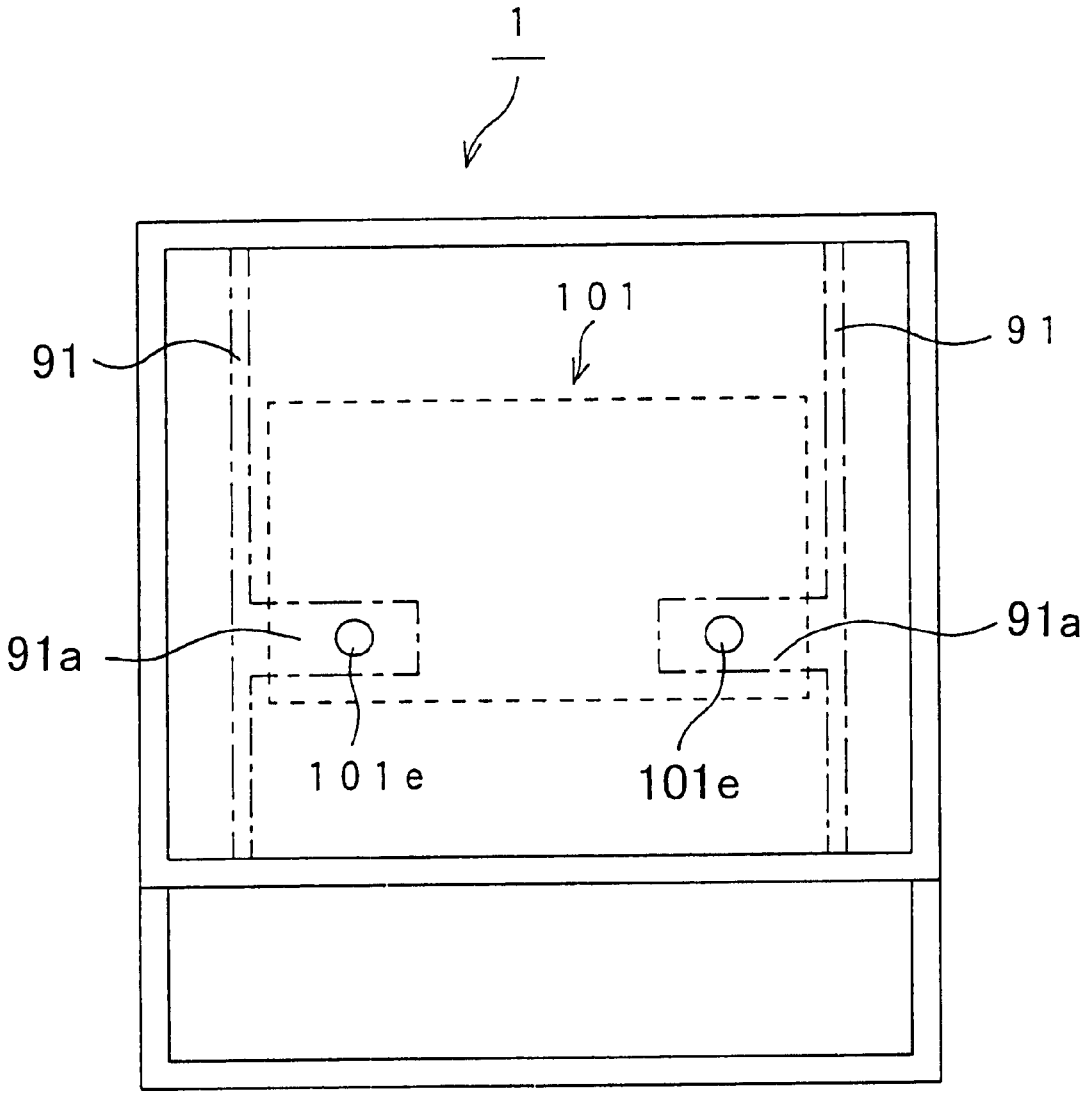
FIG. 4 is a rear elevation of the fixing device of the invention.
Figure 6:
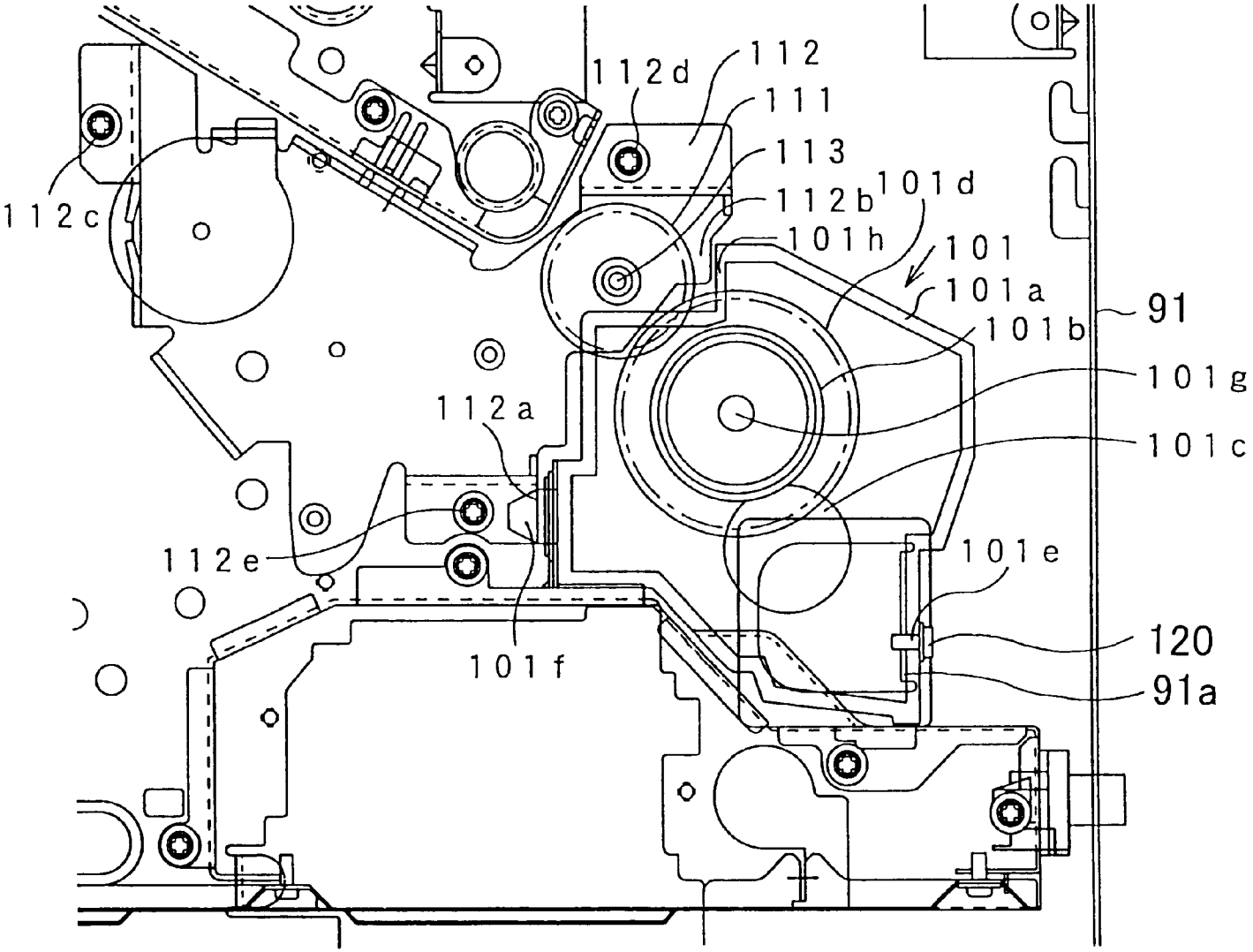
FIG. 6 is a side view showing the fixing device and its peripheral parts of the invention when the drive gear rotates.

As shown in FIG. 3, the fixing device frame 101*a* is provided with a fixing part 101*k* that serves as a center of rotation of the fixing device frame 101*a*. The fixing part 101*k* includes screw holes 101*e* and a recess 101*j*. The supporting frame 91 is provided with supporting arms 91*a* bent perpendicularly as shown in FIGS. 4, 5, and 6. The fixing frame 101*a* is fixed to the supporting frame 91 by inserting the supporting arms 91*a* into the recess 101*j* and tightening screws 120 in the screw holes 101*e*.

The fixing part 101*k* is provided at a place of the fixing device frame 101*a* satisfying the following conditions where: A vector whose starting point is a contact point between the heat roller gear 101*d* and the drive gear 111 and whose endpoint is the fixing part 101*k*, is rotated by 170° counterclockwise in FIGS. 5 and 6, relative to a vector whose starting point is the contact point and whose endpoint is a center of rotation of the drive gear 111.

The fixing device frame 101*a* has a conical projecting part 101*f* (on the left in FIGS. 5 and 6). The projecting part 101*f* is half inserted into a hole 112*a* in the gear plate 112, and allowed to move back and forth (from left to right in FIGS. 5 and 6). The fixing device frame 101*a* is fixed to the supporting frame 91 such that all fixing points between the fixing device frame 101*a* and the supporting frame 91 are arranged in a line. The number of fixing points can be one or more. According to the above structure, the fixing device frame 101*a* can rotate about the line by exerting a driving force received from the drive gear 111 as a torque and move close to the gear plate 112.

The fixing device frame 101*a* has a contact part 101*h* on a side facing the gear plate 112. The gear plate 112 has a contact part 112*b* on a side facing the fixing device frame 101*a*. When the heat roller gear 101*d* is not driven, there is a fixed clearance of between about 0.3 mm and about 3.5 mm, preferably about 1.3 mm, between the contact parts 101*h* and 112*b* as shown in FIG. 5. When the heat roller gear 101*d* is driven by the drive gear 111, the contact parts 101*h* and 112*b* are in contact with each other as shown in FIG. 6.

The recording sheet fed to the fixing device 101 via the conveying belt 27 is held between the heat roller 101*b* and the pressure roller 101*c* and fed at a fixed speed by rotation of the heat roller 101*b*. The toner image is fixed onto the recording sheet by the application of pressure from the heat roller 101*b* and the pressure roller 101*c* and the application of heat of the heat roller 101*b*.

When the heat roller gear 101*d* is driven by the drive gear 111, a driving force transmitted to the heat roller gear 101*d* acts as a torque applied to the fixing device frame 101*a*. The acting point of the torque is the contact point between the drive gear 111 and the heat roller gear 101*d* (a point where the drive gear 111 engages with the heat roller gear 101*d*). The torque acts in a direction where the heat roller gear 101*d* in the contact point is rotated by 20° (corresponding to the pressure angle $\alpha$ of the heat roller gear 101*d*) counterclockwise in FIG. 6. The pressure angle $\alpha$ is the acute angle between the common normal to the profiles at the contact point and the common pitch plane. The pressure angles of 14.5° to 20° have been adopted by the gear industry for standard gears.

As the fixing device frame 101*a* is fixed to the supporting frame 91 at the fixing part 101*k* as described above, it is rotated about the fixing part 101*k* by the torque. The direction of rotation of the fixing device frame 101*a* is defined by the position of the fixing part 101*k*, the acting point of the torque and the direction of the torque. In the embodiment, the fixing device frame 101*a* is rotated counterclockwise (in FIG. 6). In other words, the fixing device frame 101*a* is rotated in a direction where the fixing device frame 101*a* and the gear plate 112 approach each other.

The center of rotation of the fixing device frame 101*a* is parallel to the axis of rotation of the heat roller gear 101*d*. When the fixing device frame 101*a* is rotated with respect to the supporting frame 91, the direction of the axis of rotation of the heat roller gear 101*d* remains unchanged with respect to the supporting frame 91. That is, the direction of rotation of the roller gear 101*d* is not changed by rotation of the fixing device frame 101*a*. Thus, when the fixing device frame 101*a* is rotated, the heat roller gear 101*d* is always coplanar with the drive gear 111, and accordingly, correctly engaged with the drive gear 111.

On the other hand, the gear plate 112 is motionlessly attached to the main unit 2. When the fixing device frame 101*a* is rotated in the above direction by the drive gear 111, the fixing device frame 101*a* moves to the gear plate 112. The contact part 101*h* of the drive gear 111 and the contact part 112*b* of the fixing device frame 101*a* are in contact with each other as shown in FIG. 6, and finally the fixing device frame 101*a* is stopped. While the drive gear 111 is rotated, the contact parts 101*h* and 112*b* are maintained in contact with each other. This can also maintain the distance between the center of rotation of the drive gear 111 and the center of rotation of the gear plate 112 to a fixed length, and the pitch accuracy between the drive gear 111 and the heat roller gear 101*d* can be correctly maintained.

Figure 7:
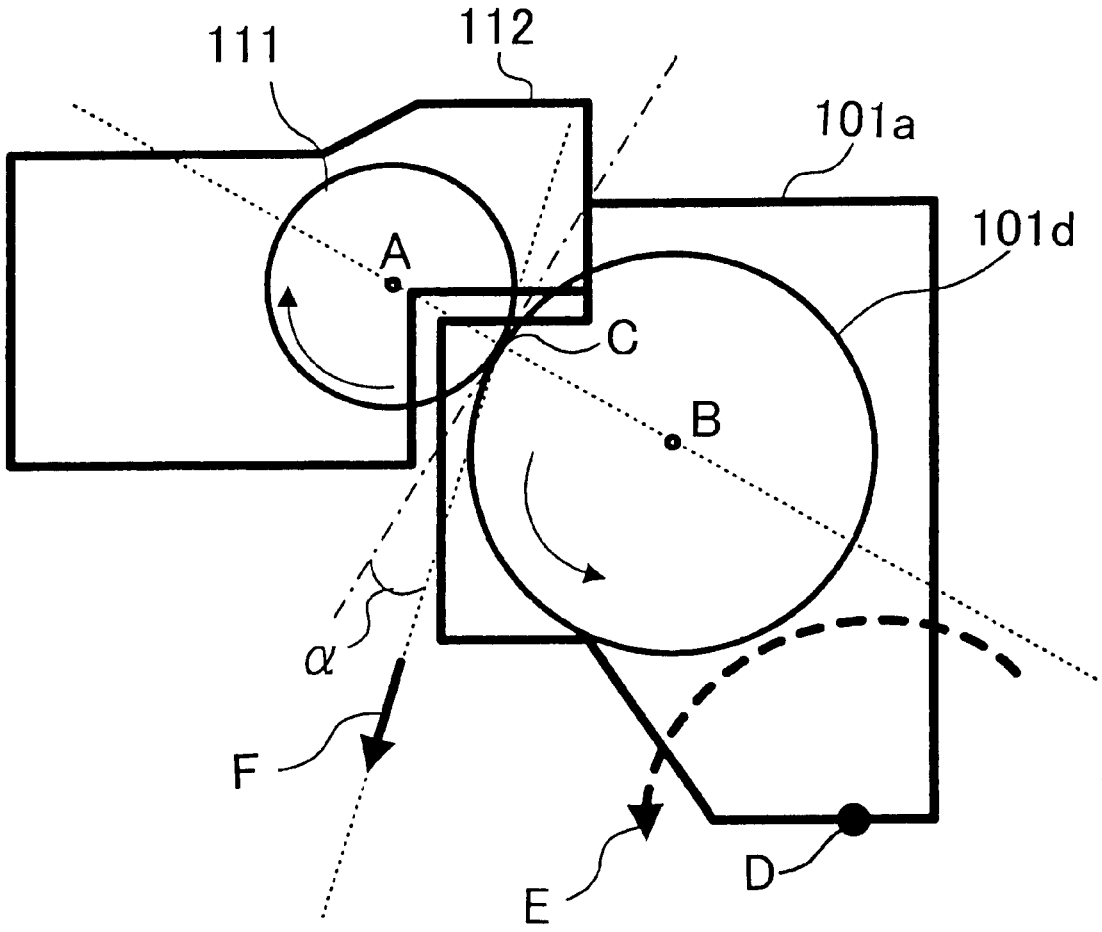
FIG. 7 is a schematic diagram showing a relative movement between the fixing device and a gear plate of the invention.
Figure 8:
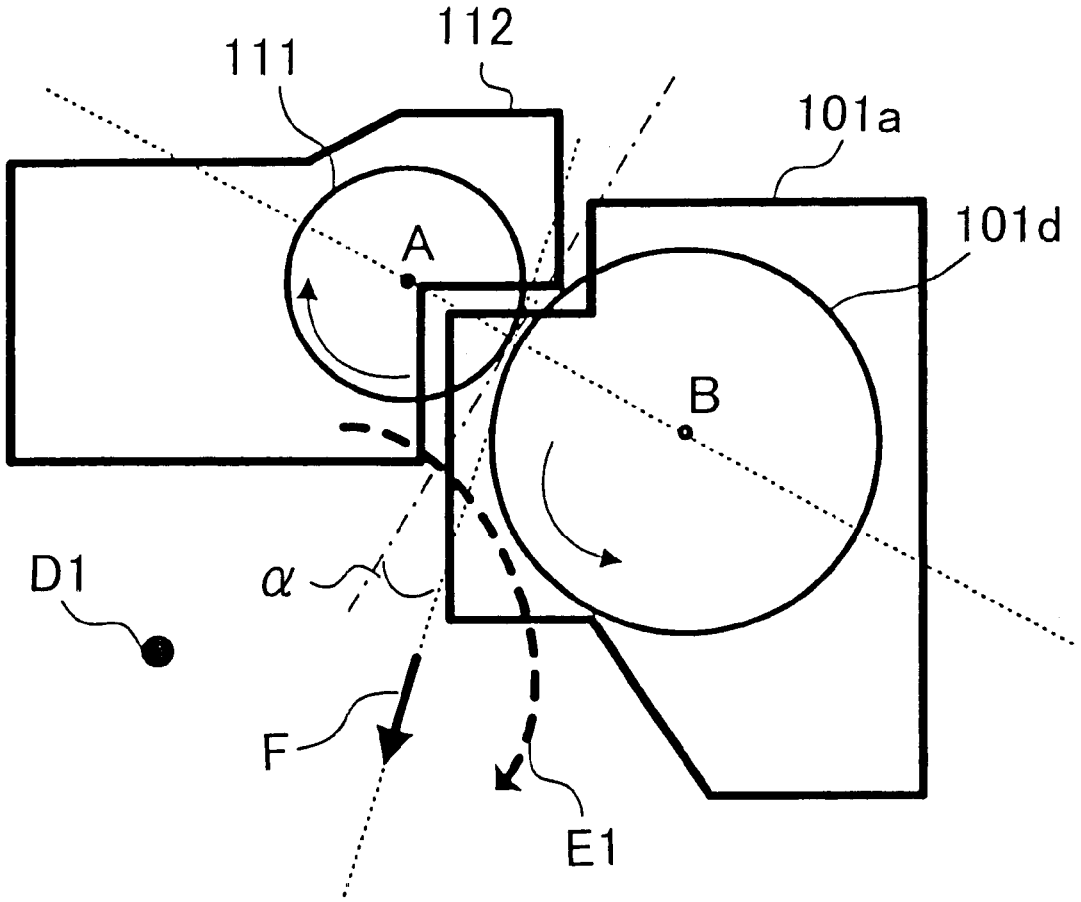
FIG. 8 is a schematic diagram showing a relative movement between the fixing device and the gear plate of the invention.
Figure 9:
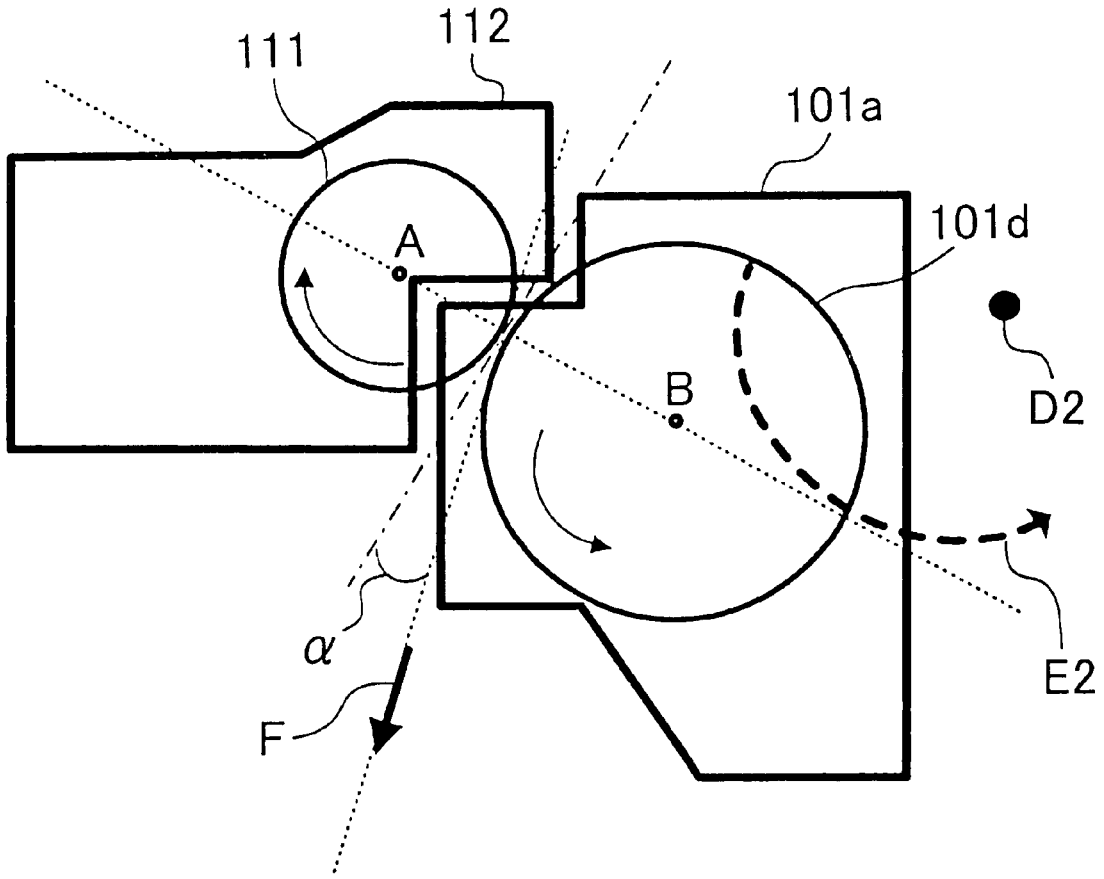
FIG. 9 is a schematic diagram showing a relative movement between the fixing device and the gear plate of the invention.

A relationship between the center of rotation of the fixing device frame 101*a* and the torque will be descried with reference to FIGS. 7 to 9. When the drive gear 111 transmits the driving force to the heat roller gear 101*d*, a fixed force acts on the heat roller gear 101*d*. The acting point of the force is the contact point C between the drive gear 111 and the heat roller gear 101*d*, and the force direction F is where the reference vector whose starting point is the contact point C and whose endpoint is the rotation center A of the drive gear 111 is rotated in a direction of rotation of the heat roller gear 111 only by an angle 90° plus pressure angle $\alpha$.

The force that acts on the heat roller gear 101*d* serves as a force that acts on the fixing device frame 101*a* supporting the heat roller gear 101*d*. As the fixing device frame 101*a* is attached so as to rotate about the rotation center D, the force that acts on the fixing device frame 101*a* serves as a torque E which causes the fixing device frame 101*a* to rotate on the rotation center D counterclockwise.

The rotation center D lies in a range from 90° plus the pressure angle $\alpha$ to 180° rotated in the direction of rotation of the heat roller gear 101*d* with resect to the reference vector. Therefore, as shown in FIG. 7, the fixing device frame 101*a* sustains the torque E that acts counterclockwise around the rotation center D. When the fixing device frame 101*a* is rotated in the direction of the torque E, the rotation center A of the drive gear 111 and the rotation center B of the heat roller gear 101*d* approach each other.

On the other hand, if the rotation center D of the fixing device frame 101*a* lies in a range of 0° to 90° plus the pressure angle $\alpha$ rotated in the direction of rotation of the heat roller gear 101*d* with respect to the reference vector, the fixing device frame 101*a* is rotated on the rotation center D1 clockwise in the direction of the torque E1 shown in FIG. 8, and the rotation center A of the drive gear 111 and the rotation center B of the heat roller gear 101*d* are separated.

If the rotation center D of the fixing device frame 101*a* lies in a position rotated more than 180° in the direction of rotation of the heat roller gear 101*d* with respect to the reference vector, the fixing device frame 101*a* is rotated on the rotation center D2 counterclockwise in the direction of the torque E2 as shown in FIG. 9, and the rotation center A of the drive gear 111 and the rotation center B of the heat roller gear 101*d* are separated.

According to the embodiment, the fixing device frame 101*a* is rotated by the driving force of the drive gear 111 until the contact parts 101*h* and 112*b* are in contact with each other, and the fixing device frame 101*a* is positioned. Therefore, the positional relationship between the fixing device frame 101*a* and the gear plate 112 is fixed. The relationship between the heat roller gear 101*d* supported to the fixing device frame 101*a* and the drive gear 111 supported to the gear plate 112 is also fixed. That is, the distance between the rotation center A of the heat roller gear 101*d* and the rotation center B of the drive gear 111 is fixed. As a result, the pitch accuracy between the heat roller gear 101*d* and the drive gear 111 is increased, and the heat roller gear 101*d* is rotated at a fixed speed smoothly at all times, thereby improving image quality.

As the gear plate 112 is integral with the supporting frame 91, the position of the drive gear 111 is invariable with respect to the laser printer 1 in the embodiment of the invention. When the drive gear 111 is engaged with, for example, a gear that transmits the driving force from a drive source to the driving gear 111 instead of the heat roller gear 101*d*, the pitch accuracy between the drive gear 111 and the gear does not deteriorate.

The fixing device frame 101*a* may be attached motionlessly to the laser printer 1, and the gear plate 112 may be attached rotatably to the main unit 2 by the driving force of the drive gear 111. Alternatively, both the fixing device frame 101*a* and the gear plate 112 may be rotatably attached to the main unit 2.

It should be understood that the invention is not limited in its application to the details of structure and arrangement of parts illustrated in the accompanying drawings. The invention is capable of other embodiments and of being practiced or performed in various ways without departing from the technical idea thereof, based on existing and well-known techniques among those skilled in the art.

What is claimed is:

1. An image forming apparatus, comprising:

a main body;

a heat roller that heats toner of a toner image formed on a printing medium to image;

a heat roller gear that transmits a rotational driving force to the heat roller;

a fixing device frame that supports the heat roller and the heat roller gear and is attached to the main body; and a gear supporting member that supports a drive gear that transmits the driving force in engagement with the heat roller gear and is attached to the main body, wherein the fixing device frame rotates on a specified rotation center in a direction to approach the gear supporting member by the driving force the drive gear transmits, and a distance between a rotation center of the heat roller gear and a rotation center of the drive gear is maintained to a specified value.

2. The image forming apparatus according to claim 1, wherein the main body has a main body frame, the gear supporting member is integrally formed with the main body frame.

3. The image forming apparatus according to claim 2, wherein the specified rotation center is parallel to an axis of rotation of the heat roller gear.

4. The image forming apparatus according to claim 2, wherein the specified rotation center is disposed in a position where the heat roller gear and the drive gear approach each other when the fixing device frame is driven by the drive gear to start rotating.

5. The image forming apparatus according to claim 4, wherein a vector whose starting point is a contact point between the drive gear and the heat roller gear and whose endpoint is the specified rotation center lies in a position where the endpoint is in a range from 90° plus a pressure angle to 180° in a direction of rotation of the heat roller gear relative to a vector whose starting point is the contact point and whose endpoint is a rotation center of the drive gear.

6. The image forming apparatus according to claim 5, further comprising:

a photosensitive drum on which an electrostatic latent image is formed;

a developing device that develops the electrostatic latent image formed on the photosensitive drum into a visualized toner image using a developing agent;

a transfer roller that holds the printing medium sandwich with the photosensitive drum, rotates to convey the printing medium and transfers the toner image onto the printing medium; and wherein toner of the toner image on the printing medium conveyed by the photosensitive drum and the transfer roller is heated by the fixing device and the toner image is fixed on the printing medium.

7. An image forming apparatus, comprising:

a main body;

a heat roller that heats toner of a toner image formed on a printing medium to fix the toner image;

a heat roller gear that transmits a rotational driving force to the heat roller;

a fixing device frame that supports the heat roller and the heat roller gear and is attached to the main body so as to rotate on a fixing point;

a gear supporting member that supports a drive gear that transmits the driving force in engagement with the heat roller gear and is attached to the main body;

a frame contact part that is provided in the fixing device frame; and a gear contact part that makes contact with the frame contact part; and wherein the fixing device frame is rotated on the fixing point by the rotational driving force the drive gear applies to the heat roller and the frame contact part makes contact with the gear contact part.

* * * * *